United States Patent [19]

Nelson

[11] Patent Number: 4,470,346

[45] Date of Patent: Sep. 11, 1984

[54] HYDRAULIC CYLINDER HAVING A PLURALITY OF RODS

[76] Inventor: Richard E. Nelson, 53 E. Tacoma, Clawson, Mich. 48017

[21] Appl. No.: 366,828

[22] Filed: Apr. 9, 1982

[51] Int. Cl.[3] ..... B30B 1/32; B30B 15/04

[52] U.S. Cl. ..... 100/214; 100/209; 100/269 R; 100/295

[58] Field of Search ..... 100/269 R, 295, 214, 100/209, 231; 72/453.18; 83/639; 92/117 A

[56] References Cited

U.S. PATENT DOCUMENTS

| | | | |
|---|---|---|---|
| 532,529 | 1/1895 | Carr . | |
| 699,936 | 5/1902 | Thomas . | |
| 751,997 | 2/1904 | Prescott . | |
| 2,308,889 | 1/1943 | McCune . | |
| 2,916,987 | 12/1959 | Hanni | 100/231 |
| 3,568,559 | 3/1971 | Fink | 100/269 R X |
| 4,027,584 | 6/1977 | Sly | 100/269 R X |

FOREIGN PATENT DOCUMENTS

| | | | |
|---|---|---|---|
| 1216954 | 4/1960 | France | 100/269 R |
| 408372 | 4/1934 | United Kingdom | 100/269 R |

*Primary Examiner*—Billy J. Wilhite

*Attorney, Agent, or Firm*—Basile, Weintraub & Hanlon

[57] ABSTRACT

An hydraulic cylinder having a plurality of piston rods is disclosed. The cylinder comprises a cylindrical hollow member having a pair of end members to enclose the cylinder, a piston positioned between the end members is supported by a plurality of rods. An end of the rods is affixed to a base of a press supporting the piston in a fixed relationship to the base. The cylinder is movable along the rods and the piston, and a die is attached to the press having a movable portion attached to the cylinder end member and a fixed portion attached to the base. Movement of the cylinder in a first direction closes the die on a workpiece, and movement of the cylinder in a counter direction opens the die.

10 Claims, 5 Drawing Figures

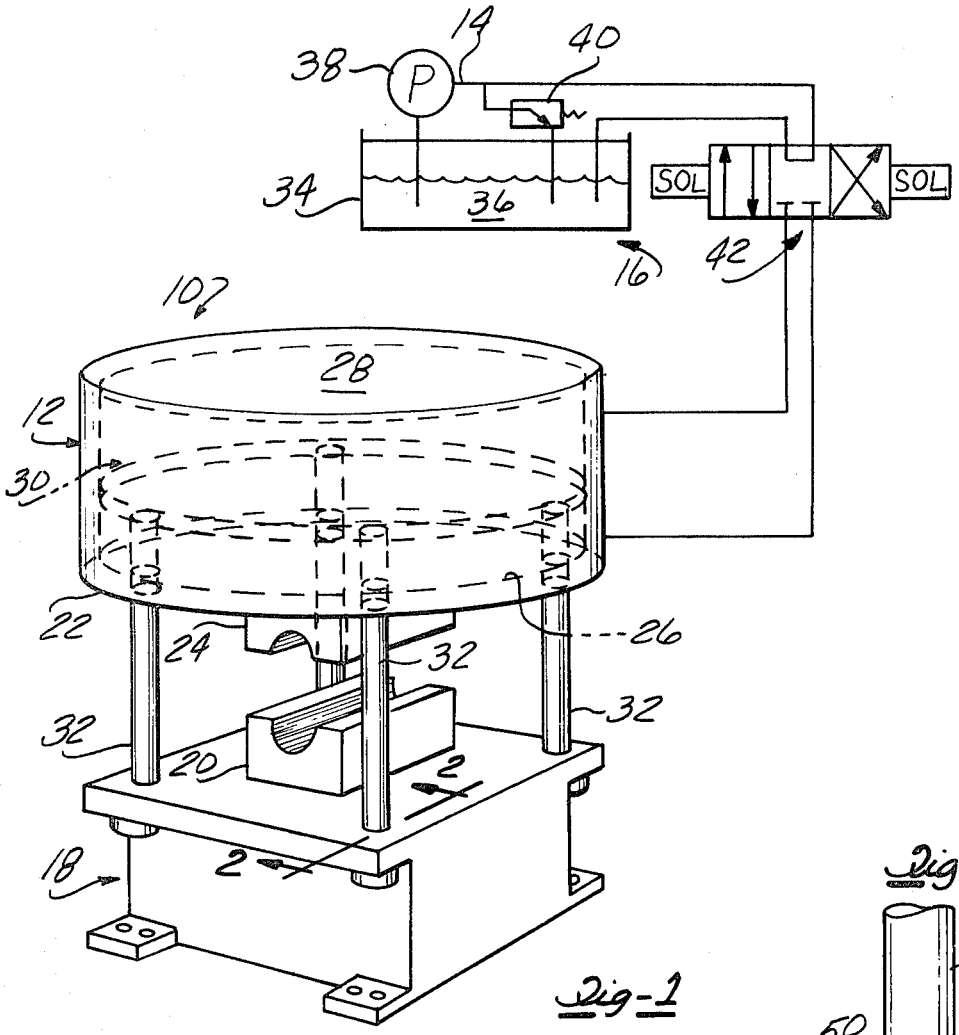
Fig-1
Fig-2
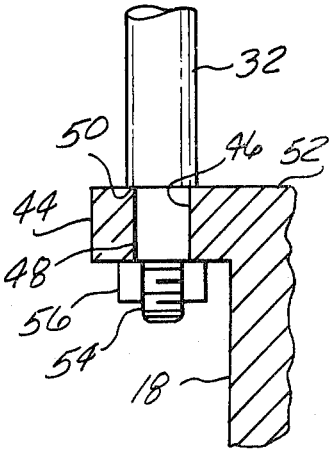
Fig-5
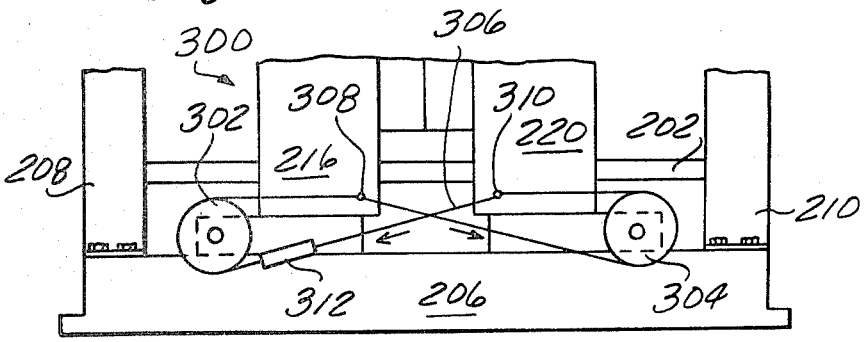

HYDRAULIC CYLINDER HAVING A PLURALITY OF RODS

BACKGROUND OF THE INVENTION

I. Field of the Invention

The present invention generally relates to the field of fluid cylinders and, in particular, the present invention is concerned with fluid cylinders having a plurality of piston rods. More specifically, the present invention is concerned with an hydraulic press utilizing a cylinder with a plurality of piston rods for opening and closing a die on a workpiece.

II. Description of the Prior Art

Fluid cylinders having a plurality of piston rods have been known for a number of years. The multiple rod cylinders known in the art have been employed in brake mechanisms, baling machines, hydraulic machinery, and steam engines. All of the multiple rod cylinders known in the art employ a fixed cylinder with a movable piston and piston rods. The present invention, as will be described subsequently, employs fixed rods and a fixed piston with a cylinder that moves along the rod and pistons to perform work. Examples of multiple rod cylinders in the prior art are disclosed in U.S. Pat. Nos. 532,529; 699,936; 751,997; and 2,308,889. These patents are relevant to the Applicant's invention in that they represent the closest prior art utilizing fluid cylinders with a plurality of piston rods.

Prior art statement

The aforementioned prior art, in the opinion of the Applicant and the Applicant's Attorney, represents the closest prior art of which the Applicant and his Attorney are aware.

SUMMARY OF THE INVENTION

The present invention, which will be described in greater detail hereinafter, comprises a fluid cylinder having a plurality of piston rods. The piston rods are secured to a base and support the piston of the cylinder a fixed distance from the base at all times. The cylinder includes a pair of end members which enclose the cylinder and the piston, and fluid ported to one side of the piston or the other causes movement of the cylinder along the piston to move the cylinder toward or away from the base. The piston rods slidingly pass through the end member closest to the base and a movable die portion is attached to the end member. A fixed die portion is attached to the base, and movement of the cylinder opens and closes the die on a workpiece. In a preferred embodiment the multiple rod cylinder of the present invention is utilized in an hydraulic press to open and close a die on a workpiece. In the preferred embodiment suitable controls are provided to port a fluid under pressure to one side of the piston or another side of the piston to open or close the die on the workpiece. The control system comprises a reservoir to contain hydraulic fluid, a pump to draw fluid from the reservoir and generate a fluid pressure, a relief valve to control the pressure of the fluid, a solenoid-operated, three-position, four-way valve to direct fluid to one side of the piston or another, and suitable hydraulic lines to interconnect the various components in the control system. The piston rods of the present invention serve as guide rods to align the fixed and movable portion of the die, and also, serve as load carrying members to carry the reaction load of the die acting on a workpiece.

It is therefore a primary object of the present invention to provide a new and improved fluid cylinder.

It is a further object of the present invention to provide a new and improved fluid cylinder having a plurality of piston rods.

It is an additional object of the present invention to provide a new and improved cylinder having a plurality of piston rods wherein the piston is held stationary relative to a support base and the cylinder moves toward and away from the base in a controlled manner.

It is yet another object of the present invention to provide a cylinder having a plurality of piston rods wherein the plurality of rods serve as part of a press frame and carry the reaction load of a die operating on a workpiece.

It is yet a further object of the present invention to provide a fluid cylinder having a plurality of rods wherein the plurality of rods serve as a guide to align movable and fixed portions of the die as they engage a workpiece.

Further objects, advantages, and applications of the present invention will become apparent to those skilled in the art of fluid cylinders when one example of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the various several views, and wherein:

FIG. 1 illustrates a perspective view of a press utilizing a cylinder having a plurality of piston rods;

FIG. 2 is a cross sectional view of the cylinder rod attachment of FIG. 1 taken along the lines 2—2 of FIG. 1;

FIG. 5 illustrates an alternate embodiment of the press of FIG. 4 wherein the movement equalizer comprises a cable mechanism.

DESCRIPTION OF THE PREFERRED EMBODIMENT

Figure 3:
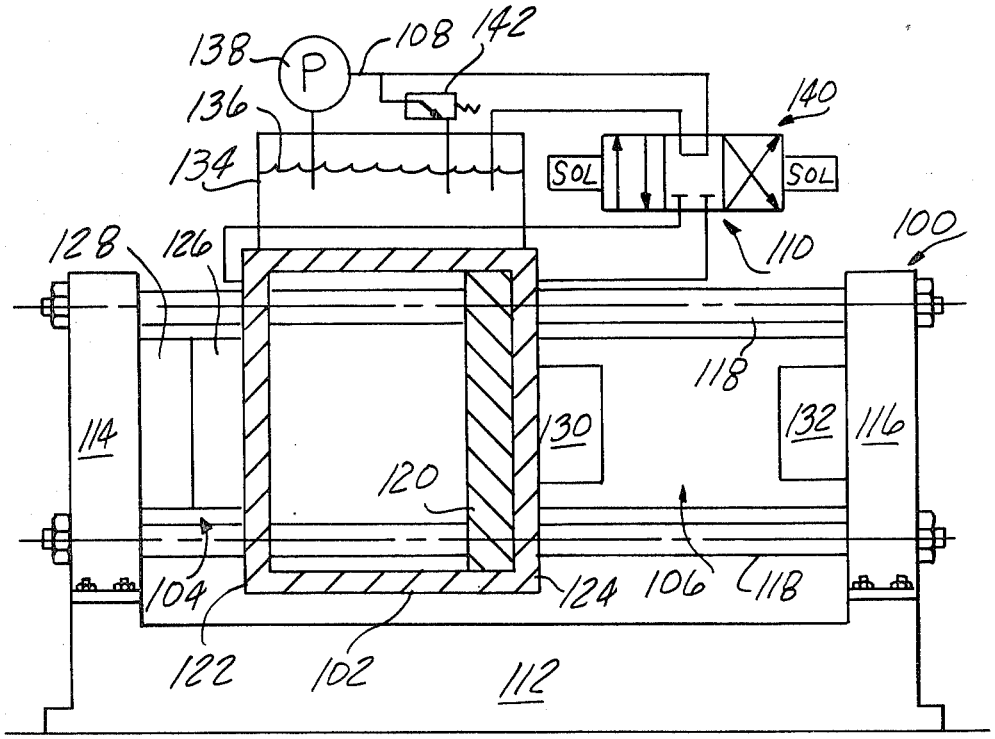
FIG. 3 is a front elevation of a press utilizing the cylinder having a plurality of rods of the present invention wherein a pair of dies may be alternately opened and closed.

Referring now to the drawing, there is illustrated in FIG. 1 one example of the present invention in the form of an hydraulic press for opening and closing a die on a workpiece. The hydraulic press 10 comprises an hydraulic cylinder 12, a source of fluid under pressure 14, fluid controls 16 for porting fluid to the cylinder in a manner to control the opening and closing of the die which will be explained subsequently in greater detail, a base member 18 supporting a fixed portion of the die 20, and a movable member 22 supporting a movable portion of the die 24. The cylinder 12 includes end members 26, 28 which enclose the cylinder, and a piston 30 is positioned between the end members 26, 28. A plurality of rods 32 are affixed to the piston 30 and supported by the base member 18 to support the piston at a fixed distance from the base. The cylinder 12 is movable along the rods 32, and the rods guide the cylinder between an open and closed position for the die members 20, 24 and carry the reaction load of the die acting on a workpiece.

The controls 16 for porting the fluid under pressure 14 to one end or another of the piston 30 in a manner to control the opening and closing of the die members 20, 24 comprises a reservoir 34 carried by the cylinder 12, an hydraulic fluid 36 is contained in the reservoir 34, and a pump 38 draws the fluid 36 from the reservoir and raises the fluid pressure to a suitable working level. A relief valve 40 establishes a working level for the fluid and relieves any excess flow back to the reservoir 36 once the suitable working pressure has been reached. A spring centered solenoid-operated, three-positioned four-way valve 42 is utilized to direct the fluid under pressure 14 to the cylinder 12 in a manner that will allow the cylinder to selectively open and close the die members 20, 24 to perform work on a workpiece. In the spring centered position illustrated in FIG. 1 the solenoid valve 42 blocks the lines to the cylinder 12 and pump flow is returned to the reservoir which locks the cylinder 12 in a fixed position. When the valve 42 is shifted to the left, high pressure fluid is directed to the bottom portion of the cylinder 12, and reservoir pressure is directed to the upper portion of the cylinder causing the cylinder to move toward the base 18 closing the die members 20, 24. When the solenoid 42 is shifted to the right, oil under pressure 14 is directed to the top portion of the cylinder 12 and reservoir pressure is directed to the bottom portion of the cylinder forcing the cylinder to move upward separating the die members 20, 24. While an hydraulic system 15 illustrated and described for opening and closing the die, it is readily apparent that other fluids under pressure may also be utilized to operate the press, such as, but not restricted, to air and steam.

The hydraulic press illustrated in FIG. 1 and described hereinabove provides a compact device capable of providing sufficient tonnage for forming parts in a die while occupying a minimum amount of floor space. The press illustrated in FIG. 1 of the drawing requires fewer parts to construct and can be manufactured at a minimum cost.

As illustrated in FIG. 2 of the drawing, the base 18 includes an overhanging flange 44 with apertures 46 formed therethrough. The rods 32 include a turned down end 48 which snugly engages the aperture 46 and provides a shoulder 50 to abut an upper wall 52 of the base 18 and secure the rods 32 to the base. The rod 32 further includes a threaded end 54 which threadingly receives a nut 56 to fixedly secure the rod 32 to the base 18.

FIG. 3 of the drawing illustrates at 100 a second embodiment of the present invention in the form of a horizontally acting press having a horizontally movable cylinder 102 for opening and closing a pair of dies 104, 106 as will be described in detail subsequently. A source of fluid under pressure 108 and fluid controls 110 operate in concert to port fluid to the cylinder 102 in a manner to control the opening and closing of the dies 104, 106. A base member 112 includes a pair of spaced apart vertical walls 114, 116 which support a plurality of rods 118 which are attached to the vertical walls 114, 116. A piston 120 is centrally attached to the rods 118 and the cylinder 102 slidingly engages the piston 120. The cylinder 102 includes a pair of end members 122, 124 which enclose the cylinder 102 with the piston 120 positioned therebetween.

The die 104 includes a first die movable member 126 attached to the end member 122 and a first die fixed member 128 attached to the vertical wall 114. The die 106 includes a second die movable member 130 attached to the end member 124, and a second die fixed member 132 attached to the vertical wall 116. When the cylinder 102 is in a first position the die 104 is closed and the die 106 is opened, and when the cylinder 102 is in a second position the die 106 is closed and the die 104 is opened.

The control 110 ports the fluid under pressure 108 to one side or another of the cylinder 102 to move the dies 104, 106 between the first position and the second position. The control 110 comprises a reservoir 134 mounted on the cylinder 102 and containing an hydraulic fluid 136. A pump 138 draws fluid from the reservoir and raises the pressure of the fluid to provide the power for operating the cylinder 102. The output of the pump 138 is directed to a spring centered three-position solenoid operated four way valve 140. A relief valve 142 sets the maximum pressure that the fluid under pressure 108 may achieve and returns any excess fluid to the reservoir 134. In the center position for the valve 140 shown in FIG. 3 of the drawing, the output of the pump 138 is returned to the reservoir and the system is idling at minimum pressure. Also, in the center position the cylinder ports are blocked and the cylinder is locked in position. When the solenoid valve 140 is moved to the right, the right hand portion of the cylinder 102 is pressurized forcing the cylinder to move to the right. When the solenoid 140 is moved by the solenoid to the left, the left hand portion of the cylinder 102 is pressurized and the cylinder 102 is urged to the first position closing the die 104. It can thus be seen that when the cylinder 102 is moved to the first position a workpiece is worked upon in the die 104, and when the piston 102 is urged to the second position a workpiece may be worked upon in the die 106. In this manner each movement of the cylinder 102 comprises a working stroke which doubles the output of the press. The skilled artisan will readily recognize that while hydraulic fluid is illustrated and described for the operation of the press in FIG. 30 of the drawing, any fluid under pressure such as steam or air may be utilized to operate the press.

Figure 4:
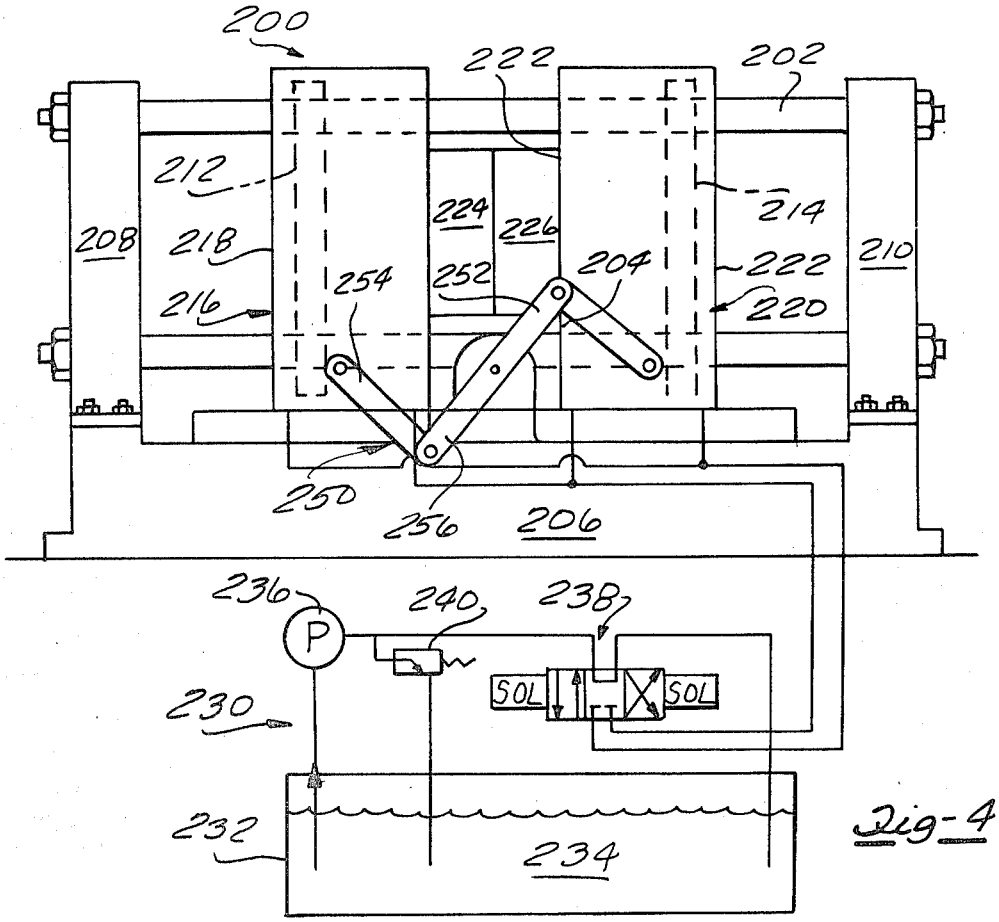
FIG. 4 illustrates a front view of a fluid operated press utilizing a pair of cylinders each cylinder sharing a plurality of rods for opening and closing a die, each cylinder supporting a portion of the die.

FIG. 4 of the drawing illustrates at 200 a dual cylinder hydraulic press having a plurality of piston rods for opening and closing a die to work on a workpiece. A base 206 supports a pair of spaced apart vertical walls 208, 210 and the plurality of rods 202 extend horizontally between the vertical walls 208, 210. A first piston 212 and a second piston 214 are secured to the rods 202 in a spaced apart manner, and a first cylinder 216 slidingly envelopes the first piston 212 with a spaced apart pair of first cylinder end members 218 enclosing the first cylinder. The plurality of rods 202 slidingly pass through the first cylinder end members 218 to allow the first cylinder to move horizontally along the plurality of rods in one direction as fluid under pressure is applied to one side of the piston 212, and allow the cylinder 216 to move horizontally along the plurality of rods in another direction when fluid under pressure is applied to another side of the piston. A second cylinder 220 slidingly envelopes the second piston 214, and a pair of spaced apart second cylinder end members 222 enclose the second cylinder with the plurality of rods 202 passing through the second cylinder end members 222 to allow the second cylinder to move horizontally along the plurality of rods toward the first cylinder when fluid under pressure is ported to a side of the second piston facing the first cylinder thus urging the second cylinder toward the first cylinder when the first cylinder is moving in the one direction. The second cylinder 220 moves horizontally along the plurality of rods 202 away from the first cylinder when fluid under pressure is supplied to a side of the second piston 214 opposed to the first cylinder at the same time the first cylinder 216 is moved in the another direction. The die 204 includes one half 224 attached to the first cylinder end member 218 facing cylinder 214, and a die other half 226 attached to cylinder end 222 facing piston 212. It can readily be seen by the skilled artisan that an increased amount of die opening is possible by employing the two cylinders moving in a counter direction, yet the amount of time required to open the die the greater distance is reduced to one half because each cylinder is operating at a velocity relative to the rods that is one half the relative velocity of the die halfs 224, 226.

A fluid control 230 for opening and closing the die 204 comprises a reservoir 232 filled with hydraulic fluid 234. A pump 236 draws hydraulic fluid from the reservoir and provides hydraulic energy for actuating the cylinders 216, 220. The output of the pump 236 is directed to a four way valve 238. The four way valve 238 a is spring centered solenoid operated three positioned valve which in a center position the outlet of the pump is returned to the reservoir and the cylinder ports are blocked to hold the die 204 in a fixed position. When the spool of the solenoid 238 is moved to the right, oil under pressure is directed to the outer ends of the piston 212, 214 to urge the cylinders 216, 220 away from each other and force the die 204 to open. When the spool of the solenoid 238 is shifted to the left, oil under pressure is ported to the inside portion of the piston 212, 214 and the die 204 is urged to a closed position to perform work on a workpiece. A relief valve 240 limits the maximum pressure that the oil can achieve by returning any excess flow to the reservoir.

As shown in FIG. 4 of the drawing the dual cylinder hydraulic press 200 includes a means 250 for causing equal and opposed movement of the first and second cylinders 216, 220. The means 250 comprises a sissors linkage having a main link 252 pivotally attached to the base 206. A first opposed link 254 is pivotally attached at one end to one end of said main link, and pivotally attached at another end to said first cylinder 216. A second opposed link 258 is pivotally attached at one end to an opposed end 260 of the main link, 252 and pivotally attached at another end to said second cylinder 220. The linkage 250 is arranged in a sissors configuration so that movement of the first cylinder 216 causes equal an opposed movement of the second cylinder 220. And the first and second cylinders always meet at a predetermined point along a plurality of rods 202.

Referring now to FIG. 5 of the drawing there is illustrated at 300 an alternate means for causing equal and opposed movement of the cylinders 216, 220 along the plurality of rods 202. The alternate means 300 comprises a pair of spaced apart shieves 302, 304 rotatingly supported by the base 206. A continuous cable 306 is threaded over the shieves and crosses between shieves, and the cable is secured at one point 308 to the first cylinder 216 and at a second point 310 to the second cylinder 220. A turn buckle 312 is employed to join the ends of the cable and take up any cable slack to prevent backlash between the motion of the cylinders 216, 220. Movement of the first cylinder 216 causes an equal and opposed movement of the second cylinder 220 and the first and second cylinders always meet at a predetermined point along the plurality of rods 202.

It can thus be seen that the present invention has provided a new and improved cylinder having a plurality of piston rods for operating on a workpiece. The cylinder of the present invention is compact providing a considerable amount of tonnage in a small package, and requiring a minimum number of parts to build the press for operating on a workpiece.

It should be understood by those skilled in the art of cylinders that other forms of the Applicant's invention may be had, all coming within the spirit of the invention and the scope of the appended claims.

Having thus described my invention what I claim is:

1. A cylinder for operating a workpiece comprising:

a piston a plurality of rods attached to the piston near the outer perimeter thereof;

a base to support the workpiece;

an end of said rods attached to said base;

a pair of end members enclosing the cylinder; and the cylinder slidingly movable along said piston to move said end members selectively toward and away from said base to perform work on the workpiece; and wherein the center of said end members is unobstructed allowing the positioning of the workpiece at the center of said end members.

2. In an hydraulic press of the type having an hydraulic cylinder for opening and closing a die on a workpiece; a source of fluid under pressure; fluid controls for porting fluid to the cylinder in a manner to control the opening and closing of the die; a base member supporting a fixed portion of the die; a movable member supporting a movable portion of the die; the improvement comprising:

the cylinder including end members enclosing the cylinder, a piston positioned between said end members, a plurality of rods affixed to said piston near the outer perimeter thereof, said rods supported by the base member at an end thereof; and wherein the cylinder comprises the movable member and is movable along said rods and wherein said rods guide the cylinder while leaving the center of said end members unobstructed and said rods carry the reaction load of the die acting of the workpiece.

3. The hydraulic press as defined in claim 2 wherein:

the base includes a pair of spaced apart vertical walls;

said rods extending horizontally between and attached to said vertical walls;

a first die having a first die movable member attached to the cylinder and a first die fixed member attached to one of said vertical walls;

a second die having a second die movable member attached to the cylinder and a second die fixed member attached to another of said vertical walls; and wherein when the cylinder is in a first position said first die is closed and said second die is open, and when the cylinder is in a second position said second die is closed and said first die is open.

4. In a hydraulic press for opening and closing a die on a workpiece including a base, a source of fluid under pressure, control means for opening and closing the die, the improvement comprising:

a pair of spaced apart vertical walls supported by the base;

a plurality of rods extending horizontally between said spaced apart vertical walls;

a first piston attached to said plurality of rods near the perimeter of said first piston, a first cylinder slidingly enveloping said first piston, a pair of spaced apart first cylinder end members enclosing said first cylinder, said plurality of rods slidingly passing through said first cylinder end members allowing said first cylinder to move horizontally along said plurality of rods in one direction as fluid under pressure is applied to one side of said piston, and allowing said cylinder to move horizontally along said plurality of rods in another direction when fluid under pressure is applied to another side of said piston;

a second piston attached to said plurality of rods near the perimeter of said second piston, a second cylinder slidingly enveloping said second piston, a pair of spaced apart second cylinder end members enclosing said second cylinder, said plurality of rods slidingly passing through said second cylinder end members allowing said second cylinder to move horizontally along said plurality of rods toward said first cylinder when fluid under pressure is ported to a side of said second piston facing said first cylinder urging said second cylinder toward said first cylinder when said first cylinder is moving in said one direction; and allowing said second cylinder to move horizontally along said plurality of rods away from said first cylinder when fluid under pressure is ported to a side of said second piston opposed to said first cylinder; and a die having a first part attached to said first cylinder and a second part attached to said second cylinder so that when said first cylinder is moved in said one direction the first and second die parts are brought together and when said first cylinder is moved in said another direction said first and second die parts are separated, and wherein the velocity of the first and second cylinders along said plurality of rods is less than the relative velocity between said first and second cylinders.

5. The hydraulic press as defined in claim 2 wherein said rods guide the movable member between the open and closed position aligning the die portions.

6. The hydraulic press as defined in claim 2 wherein said rods slidingly pass through at least one of said end members.

7. The hydraulic press as defined in claim 4 further comprising means for causing equal and opposed movement of the first and second cylinders so that they move away from and toward each other at equal speed and always meet at a common point along said plurality of rods.

8. The hydraulic press as defined in claim 7 wherein said equal movement means comprises a sissors linkage comprising:

a main link pivotally attached to the base;

a first opposed link pivotally attached at one end to one end of said main link and pivotally attached at another end to said first cylinder;

a second opposed link pivotally attached at one end to an opposed end of said main link and pivotally attached at another end to said second cylinder; and wherein movement of said first cylinder causes an equal and opposed movement of said second cylinder and said first and second cylinders always meet at a predetermined point along said plurality of rods.

9. The hydraulic press as defined in claim 7 wherein the equal movement means comprises:

a pair of spaced apart shieves rotatingly attached to the base;

a cable threaded over said shieves and crossing between shieves, said cable secured at one point to said first cylinder and at a second point to said second cylinder;

a turn buckle for joining ends of said cable and taking up cable slack; and wherein movement of said first cylinder causes an equal and opposed movement of said second cylinder and said first and second cylinders always meet at a predetermined point along said plurality of rods.

10. A cylinder for operating on a workpiece comprising:

a piston;

a base to support the workpiece;

a pair of end members enclosing the cylinder; a plurality of rods passing through one of said end members and attached at one end to said piston near the outer perimeter thereof, another end of said rods attached to said base; and the cylinder slidingly movable along said piston to move said end members selectively toward and away from said base to perform work on the workpiece, and wherein the central portion of said end members is unobstructed allowing the workpiece to be placed at the center of said end members.

* * * * *